US012753977B2

(12) United States Patent
Moon et al.

(10) Patent No.: US 12,753,977 B2
(45) Date of Patent: Oct. 6, 2026

(54) HEAT EXCHANGER

(71) Applicant: KYUNGDONG NAVIEN CO., LTD., Gyeonggi-do (KR)

(72) Inventors: Seong Sik Moon, Seoul (KR); In Chul Jeong, Seoul (KR)

(73) Assignee: KYUNGDONG NAVIEN CO., LTD., Gyeonggi-do (KR)

( * ) Notice: Subject to any disclaimer, the term of this patent is extended or adjusted under 35 U.S.C. 154(b) by 95 days.

(21) Appl. No.: 18/725,154

(22) PCT Filed: Dec. 6, 2022

(86) PCT No.: PCT/KR2022/019742
§ 371 (c)(1),
(2) Date: Jun. 28, 2024

(87) PCT Pub. No.: WO2023/128359
PCT Pub. Date: Jul. 6, 2023

(65) Prior Publication Data

US 2025/0060171 A1 Feb. 20, 2025

(30) Foreign Application Priority Data

Dec. 29, 2021 (KR) ..... 10-2021-0191767

(51) Int. Cl.
*F28F 1/14* (2006.01)
*F24H 8/00* (2022.01)
(Continued)

(52) U.S. Cl.
CPC ..... *F28F 1/14* (2013.01); *F24H 8/00* (2013.01); *F28D 1/0535* (2013.01); *F28F 1/325* (2013.01); *F28F 17/005* (2013.01)

(58) Field of Classification Search
CPC ... F24H 8/00; F24H 8/006; F28D 1/02; F28D 1/0535; F28F 1/14; F28F 1/32; F28F 1/325; F28F 17/00; F28F 17/005
See application file for complete search history.

(56) References Cited

U.S. PATENT DOCUMENTS

2010/0116226 A1* 5/2010 Lovascio ..... F24H 9/1836 122/367.1
2015/0300687 A1* 10/2015 Cui ..... F24H 1/406 126/110 R
(Continued)

FOREIGN PATENT DOCUMENTS

JP 05045023 A * 2/1993
JP H05-045023 A 2/1993
(Continued)

OTHER PUBLICATIONS

Machine Translation of JP 09-159314 (Year: 2025).*
(Continued)

*Primary Examiner* — Eric S Ruppert
*Assistant Examiner* — Hans R Weiland
(74) *Attorney, Agent, or Firm* — McDonald Hopkins LLC

(57) ABSTRACT

The present invention relates to a heat exchanger comprising: a tube having a flow space formed therein through which a heating medium flows; and a plurality of heat exchange fins coupled to the outer surface of the tube and spaced apart from each other along the extension direction of the tube, wherein heat exchange fins adjacent to each other, from among the plurality of heat exchange fins, are formed in different shapes when viewed in the extension direction of the tube.

6 Claims, 12 Drawing Sheets

(51) Int. Cl.

| | |
|---|---|
| ***F28D 1/053*** | (2006.01) |
| ***F28F 1/32*** | (2006.01) |
| ***F28F 17/00*** | (2006.01) |

(56) References Cited

U.S. PATENT DOCUMENTS

| | | | | |
|---|---|---|---|---|
| 2016/0273850 | A1* | 9/2016 | Okamoto | F28F 1/32 |
| 2018/0106498 | A1* | 4/2018 | Nishino | F24H 1/40 |
| 2018/0156523 | A1* | 6/2018 | Park | F25B 47/02 |

FOREIGN PATENT DOCUMENTS

| | | | | |
|---|---|---|---|---|
| JP | 09159314 | A | * | 6/1997 |
| JP | H09-159314 | A | | 6/1997 |
| JP | 10238897 | A | * | 9/1998 |
| JP | H10-238897 | A | | 9/1998 |
| JP | 2011-080707 | A | | 4/2011 |
| KR | 10-0360858 | B1 | | 11/2002 |
| KR | 10-1987699 | B1 | | 6/2019 |

OTHER PUBLICATIONS

Patent Cooperation Treaty (PCT), International Search Report and Written Opinion for Application PCT/ KR2022/019742 filed on Dec. 6, 2022, mailed Mar. 15, 2023, International Searching Authority, KR.

Korean Patent Office, Notification of First Office Action for corresponding application No. 10-2021-0191767, issued on Jun. 20, 2024, Korea, 5 pages.

* cited by examiner

HEAT EXCHANGER

CROSS-REFERENCES TO RELATED APPLICATIONS

This application is a national stage application filed under 35 U.S.C. 371 based on International Patent Application No PCT/KR2022/019742 filed on Dec. 6, 2022 which claims priority to Korean Patent Application No. 10-2021-0191767 filed on Dec. 29, 2021 the disclosures of which are incorporated herein by reference in their entireties.

TECHNICAL FIELD

The present disclosure relates to a heat exchanger.

BACKGROUND ART

Generally, a water heater, such as a boiler or a water heating device, is a device that is used for indoor heating or hot water by heating a heating medium by using combustion heat generated during a combustion process and circulating the heated heating medium along a pipeline.

Among water heaters, a condensing type water heater includes a sensible heat exchange part that absorbs sensible heat of combustion gases generated in a combustion chamber to increase thermal efficiency, and a latent heat exchange part that absorbs latent heat of condensate in water vapor contained in combustion gas that has exchanged heat in the sensible heat exchange part.

FIGS. 1 and 2 illustrate a latent heat exchange part 1 of a downward combustion type water heater, among conventional condensing type water heaters. The conventional latent heat exchange part 1 includes a tube 2, through which a heating medium flows in an interior thereof, and a plurality of heat exchange fins 4 that are coupled to an outer space of the tube 2. For example, the heat exchange fin 4 may include concave portions 5, and tip end portions 6 between the concave portions 5.

While the combustion gas heated through heat exchange passes through the latent heat exchange part 1 (see direction "A" of FIG. 2), the water vapor contained therein may be condensed into water, and then, the heat exchange fins 4 and the tube 2 may absorb the latent heat of condensation of the vapor to heat the heating medium that flows in an interior of the tube 2 (see direction "B" of FIG. 2). Furthermore, then, the condensate "w" formed in the outer space of the tube 2 may flow downward along a flow (see direction "f" of FIG. 1) of the combustion gas and be discharged down a tip end part of the heat exchange fin 4. The condensate "w" may be formed between a plurality of heat exchange fins (4) and then may be discharged by the weight of the condensate "w" and the flow of the combustion gas.

However, according to the conventional technology, to increase a heat transfer area, a structure that causes an increase in the number of heat exchange fins 4 is used. and in this case, an interval between the heat exchange fins 4 becomes smaller, and the resulting surface tension prevents the condensate "w" formed between the heat exchange fins 4 from being discharged smoothly.

The latent heat exchange part 1 improves a condensation and latent heat exchange performance as long as the combustion gas flows smoother as the condensate formed between the heat exchange fins is discharged rapidly whereby a performance of the burning device may deteriorate when the condensate is discharged with difficulty.

Accordingly, it is necessary to improve a structure that may rapidly discharge the condensate.

Technical Problem

The present disclosure has been designed to solve the above-mentioned problems, and provides a heat exchanger that improves a condensation and latent heat exchange performance by allow condensate to be smoothly discharged.

Technical Solution

According to an aspect of the present disclosure, a heat exchanger includes a tube including a flow space, in which a heating medium flows, in an interior thereof, and a plurality of heat exchange fins coupled to an outer surface of the tube, and disposed to be spaced apart from each other along an extension direction of the tube, adjacent ones of the plurality of heat exchange fins have different shapes when viewed in the extension direction of the tube.

When any one of the adjacent heat exchange fins is defined as a first heat exchange fin, and the other is defined as a second heat exchange fin, the first heat exchange fin and the second heat exchange fin may be repeatedly disposed along the extension direction of the tube, and shapes of parts thereof, which are located on a lower side of the tube, may be formed to be different.

A difference between heights of a lower end of the tube and a lower end of the first heat exchange fin may be formed to be different from a difference between heights of a lower end of the tube and a lower end of the second heat exchange fin.

When the extension direction of the tube is defined as a first direction, and a direction being perpendicular to the first direction and parallel to a ground is defined as a second direction, the first heat exchange fin may include a plurality of first recessed part formed to be recessed in an upward direction and disposed along the second direction, the second heat exchange fin may include a plurality of second recessed parts formed to be recessed in the upward direction and disposed along the second direction, and the plurality of first recessed parts and the plurality of second recessed parts may be disposed alternately when viewed in the first direction.

When an imaginary center line extending from a center of the tube in the second direction is defined as the imaginary center line when the first heat exchange fin is viewed in the first direction, the first heat exchange fin may include first lower end parts formed between the plurality of first recessed parts, and the first lower end parts may be located on the imaginary center line.

When an imaginary center line extending from a center of the tube in the second direction is defined as the imaginary center line when the second heat exchange fin is viewed in the first direction, the second heat exchange fin may include a plurality of second lower end parts formed between the plurality of second recessed parts, and the plurality of second lower end parts may be disposed on both sides of the imaginary center line in the second direction.

According to another aspect of the present disclosure, a heat exchanger includes a tube including a flow space, in which a heating medium flows, in an interior thereof, and a plurality of heat exchange fins coupled to an outer surface of the tube, and disposed to be spaced apart from each other along an extension direction of the tube, and adjacent ones of the plurality of heat exchange fins are formed such that at least partial areas thereof, which are located on a lower side of the tube, do not overlap each other when viewed in the extension direction of the tube.

Advantageous Effects

According to the present disclosure, as the shapes and sizes of the adjacent heat exchange fins are formed differently, the force in the direction of the gravity is added to the condensate formed between the facing surfaces whereby the condensate may be smoothly discharged.

Therefore, according to the present disclosure, the thermal efficiency of the heat exchanger can be increased by increasing the condensation and latent heat exchange performance.

MODE FOR INVENTION

This application claims the benefit of priority to Korean Patent Application No. 10-2021-0191767, filed in the Korean Intellectual Property Office on Dec. 29, 2021, the entire contents of which are incorporated herein by reference.

Hereinafter, embodiments of the present disclosure will be described in detail with reference to the accompanying drawings.

First, the embodiments described hereinafter are embodiments that are suitable for helping understanding of the technical features of a heat exchanger of the present disclosure. However, the technical features of the present disclosure are not applied to be limited to the embodiments described below, and various modifications are possible within the technical scope of the present disclosure.

A heat exchanger according to the present disclosure may be a latent heat exchange part of a condensing type burning device, and may be configured to heat a heating medium by using combustion heat. The heated heating medium is circulated along a pipeline, and is used for indoor heating or hot water. However, the heat exchanger in the present disclosure is not limited to the latent heat exchange part of the condensing type burning device, but may be applied to fin-tube type heat exchangers without limitation.

Hereinafter, first and second embodiments of the heat exchanger will be described according to the present disclosure.

First Embodiment

Figure 3:
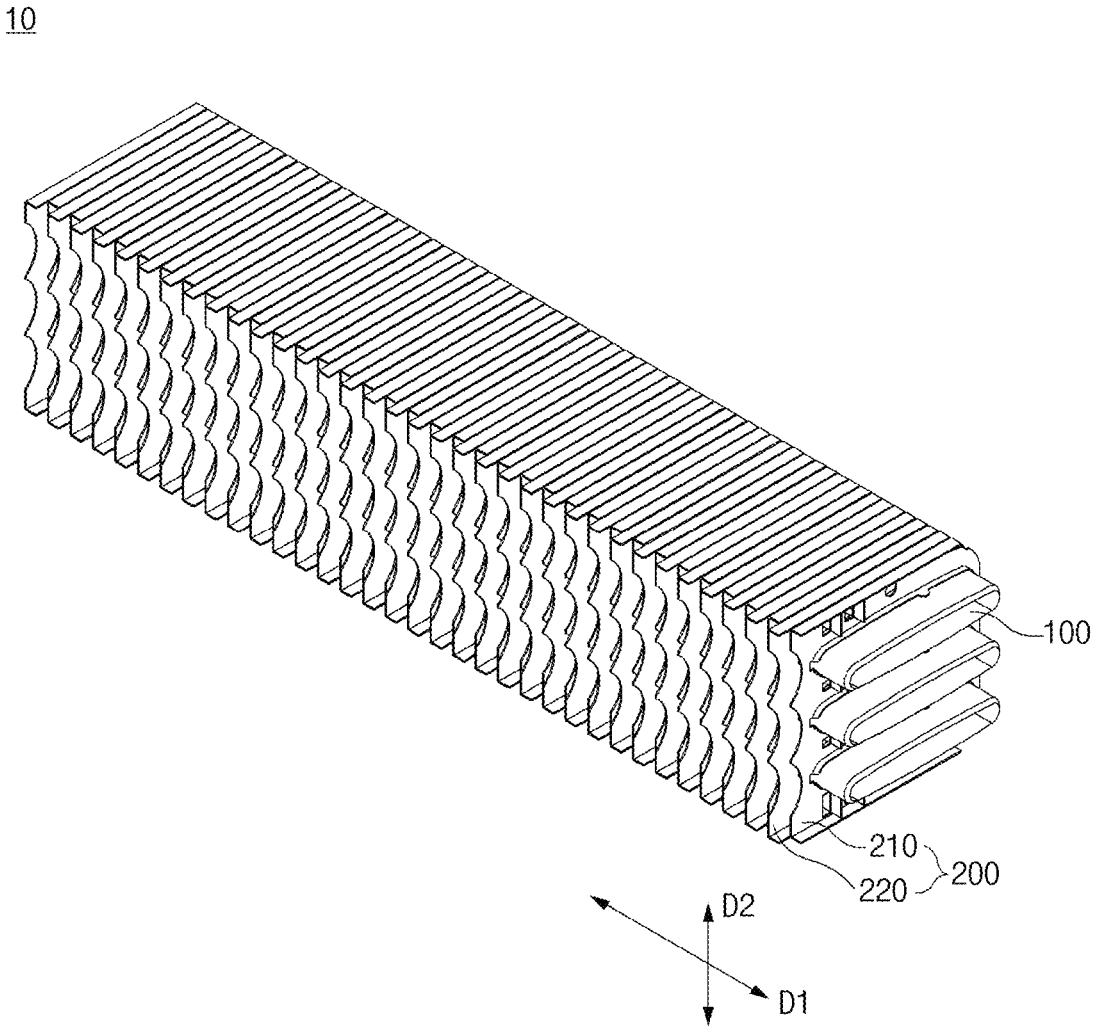
FIG. 3 is a perspective view illustrating a heat exchanger according to a first embodiment of the present disclosure.
Figure 4:
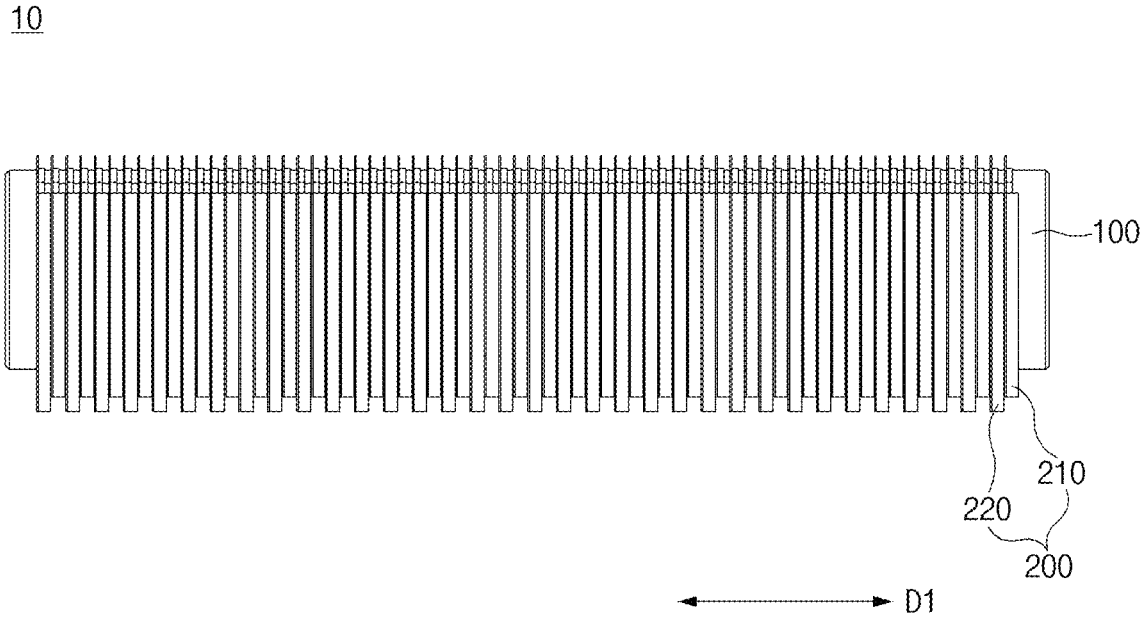
FIG. 4 is a front view of a heat exchanger according to a first embodiment of the present disclosure.
Figure 5:
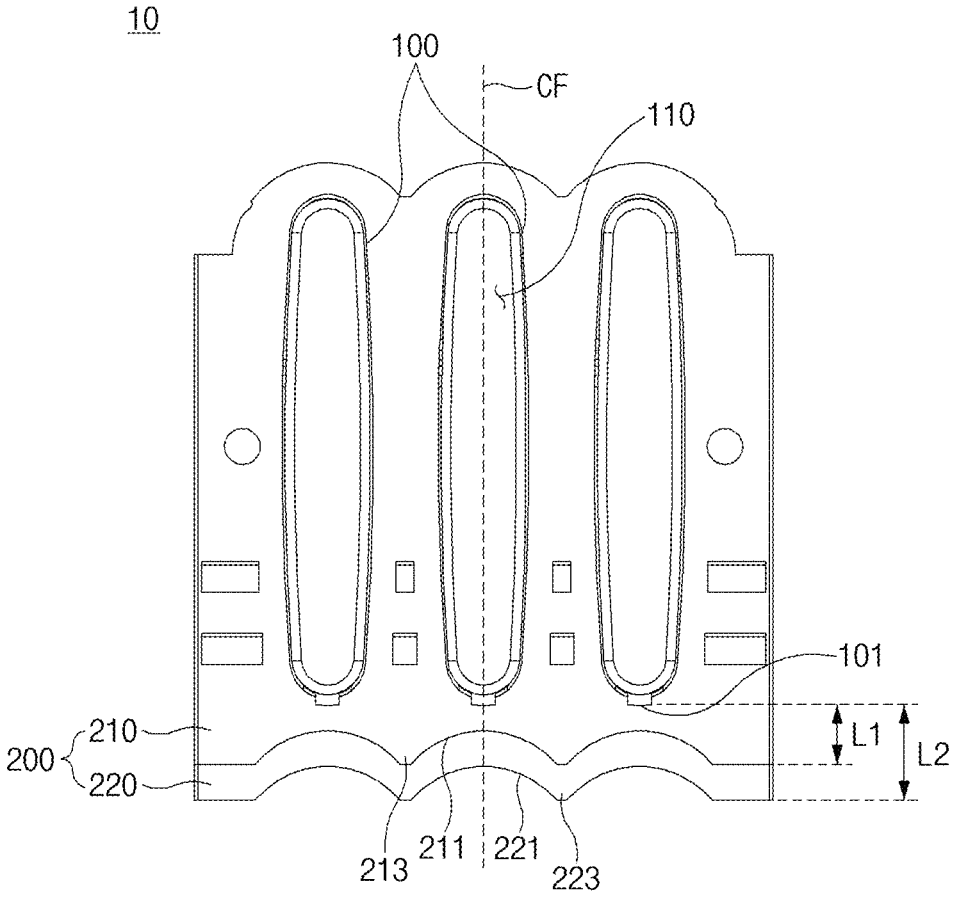
FIG. 5 is a view illustrating a heat exchanger according to a first embodiment of the present disclosure, and is a side view of FIG. 4, when viewed from a lateral side.
Figure 6:
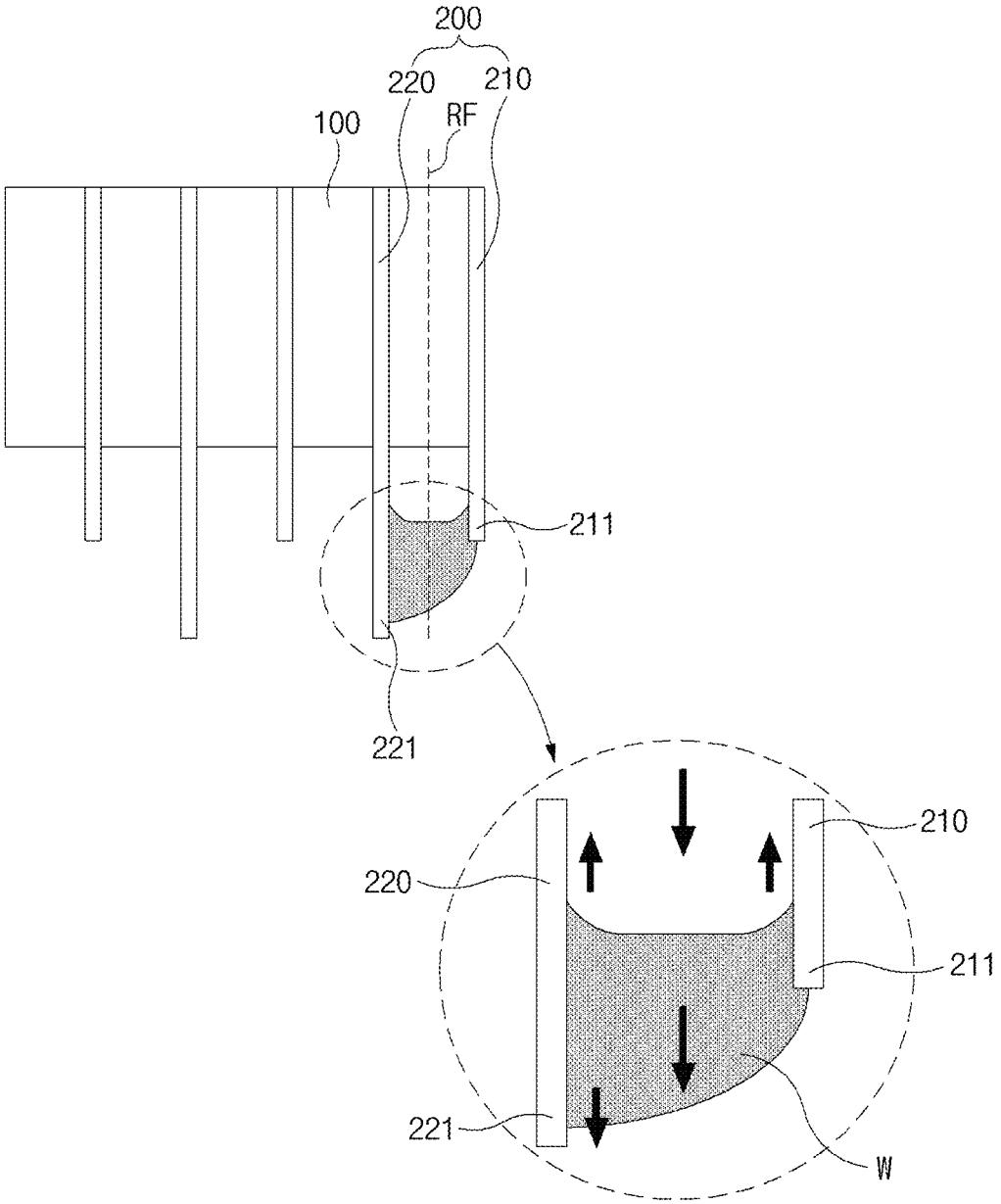
FIG. 6 is a view illustrating a heat exchanger according to a first embodiment of the present disclosure, and is a view illustrating a part of FIG. 4 and an enlarged view thereof.

FIGS. 3 to 6 illustrate a heat exchanger 10 according to the first embodiment of the present disclosure. FIG. 3 is a perspective view illustrating a heat exchanger according to a first embodiment of the present disclosure, FIG. 4 is a front view of the heat exchanger according to the first embodiment of the present disclosure, FIG. 5 is a view illustrating the heat exchanger according to the first embodiment of the present disclosure, and is a side view of FIG. 4, when viewed from a lateral side, and FIG. 6 is a view illustrating the heat exchanger according to the first embodiment of the present disclosure, and is a view illustrating a part of FIG. 4 and an enlarged view thereof.

Referring to FIGS. 3 to 6, the heat exchanger 10 according to an embodiment of the present disclosure may include a tube 100 and a heat exchange fin 200.

The tube 100 includes a flow space 110, in which the heating medium flows, in an interior thereof. For example, the latent heat exchanger 10 may include a heating medium returning pipe, through which the heating medium is recovered after passing through a source of demand for heating or a source of demand (not illustrated) for hot water, and a heating medium discharge pipe, through which the heating medium that has passed via the latent heat exchanger 10 is discharged to the sensible heat exchanger 10 through a connection pipe. A plurality of tubes 100 may be disposed to be spaced apart from each other in a forward/rearward direction between the heating medium recovery pipe and the heating medium discharge pipe. The heating medium may be heated while flowing through the flow space 110 of the tube 100.

For convenience of description, an extension direction (a leftward/rightward direction of FIG. 4) of the tube 100 is defined as a first direction D1 and a direction that is perpendicular to the first direction D1 and is parallel to a ground is defined as a second direction D2. Then, a plurality of tubes 100 may be disposed to be spaced apart from each other in the second direction D2, and the heating medium may be heated while flowing in the first direction D1 in the flow space 110.

A plurality of heat exchange fins 200 are coupled to an outer space of the tube 100, and may be disposed to be spaced apart from each other along the extension direction of the tube 100. As illustrated, the plurality of heat exchange fins 200 may be provided on a surface of the tube 100, and may be disposed to be spaced apart from each other at regular intervals along the first direction D1.

Here, adjacent ones 200 of the plurality of heat exchange fins 200 may be formed in different shapes, when viewed in the extension direction of the tube 100.

In more detail, when one of the adjacent heat exchange fins 200 is defined as a first heat exchange fin 210 and the other is defined as a second heat exchange fin 220, the first heat exchange fin 210 and the second heat exchange fin 220 may have different shapes at portions that are located on a lower side of the tube 100. Here, the different shapes mean that the shapes of the first heat exchange fin 210 and the second heat exchange fin 220 when viewed in the first direction D1 are not the same, and also include the meaning that not only external profiles thereof but also sizes thereof are different.

Here, the first heat exchange fin 210 means arbitrary any one of the plurality of heat exchange fins 200, and the second heat exchange fin 220 means a heat exchange fin 200 that is adjacent to the first heat exchange fin 210. The first heat exchange fin 210 and the second heat exchange fin 220 may be repeatedly disposed along the first direction D1 that is an extension direction of the tube 100. In other words, the first heat exchange fin 210 and the second heat exchange fin 220 may be alternately disposed along the first direction D1.

In other words, adjacent ones 200 of the plurality of heat exchange fins 200 may be formed such that at least partial areas of the portions that are located on a lower side of the tube 100 do not overlap other when viewed in the extension direction of the tube 100. More detail, there is a non-overlapping area between the first heat exchange fin 210 and the second heat exchange fin 220 when viewed in the first direction D1.

In other words, the adjacent ones 200 of the plurality of heat exchange fins 200 may be disposed at a center of the adjacent heat exchange fins 200, and may be formed asymmetrically to each other with respect to a reference surface RF that are an imaginary surface that is parallel to the heat exchange fins 200. In detail, assuming that there is the reference surface RF between the first heat exchange fin 210 and the second heat exchange fin 220, the first heat exchange fin 210 and the second heat exchange fin 220 may be formed to be asymmetrical to each other with respect to the reference surface RF.

In this way, when the adjacent heat exchange fins 200 have different shapes or sizes, a surface tension that is a force in a direction of the gravity may be added to condensate "w" formed between opposing surfaces, and thus, the condensate "w" may be smoothly discharged (see FIG. 6). A description thereof will be made later. As the condensate "w" is smoothly discharged, combustion gas may flow smoothly, and thus, a condensation and latent heat exchange performance may be increased.

For example, referring to the first embodiment of the present disclosure illustrated in FIGS. 5 and 6, a difference L1 between heights of a lower end 101 of the tube 100 and a lower end of the first heat exchange fin 210 may be formed to be different from a difference L2 between heights of a lower end 101 of the tube 100 and a lower end of the second heat exchange fin 220.

For example, the height of the lower end part of the second heat exchange fin 220 may be smaller than the height of the lower end of the first heat exchange fin 210. That is, the first heat exchange fin 210 and the second heat exchange fin 220 may have the same cut shape at the lower ends thereof, and the lower end of the second heat exchange fin 220 may extend further from the height of the lower end 101 of the tube 100 than that of the first heat exchange fin 210. Accordingly, the heat exchange fins 210 and 220 having different heights at the lower ends thereof may be alternately disposed along the first direction D1.

Referring to FIG. 6, because the lower end part of the second heat exchange fin 220 extends longer downward than the lower end part of the first heat exchange fin 210, a surface tension may be added between a more extending part of the lower end part of the second heat exchange fin 220 and the condensate "w". Then, the added surface tension may be a force that is applied to the condensate "w" in the direction of the gravity.

In more detail, when the condensate is formed between the first heat exchange fin 210 and the second heat exchange fin 220, a force that acts on the condensate "w" in an upward direction may be a surface tension between the condensate "w" and the first and second heat exchange fins 210 and 220, and a force that acts on the condensate "w" in a downward direction may be a force that is caused by a wind speed of the combustion gas and a weight of the condensate "w" itself. In addition, when the second heat exchange fin 220 extends further downward than the first heat exchange fin 210, a surface tension between the more extending part of the second heat exchange fin 220 and the condensate "w" may be added to the force that acts on the condensate "w" in the downward direction. In this way, according to the present disclosure, a force that acts on the condensate "w" in the direction of the gravity (the downward direction) is added as compared to the conventional technology, and thus, the condensate "w" that is formed between the first heat exchange fin 210 and the second heat exchange fin 220 falls to a lower side more easily. Accordingly, the condensate "w: may be discharged smoothly.

Second Embodiment

Figure 7:
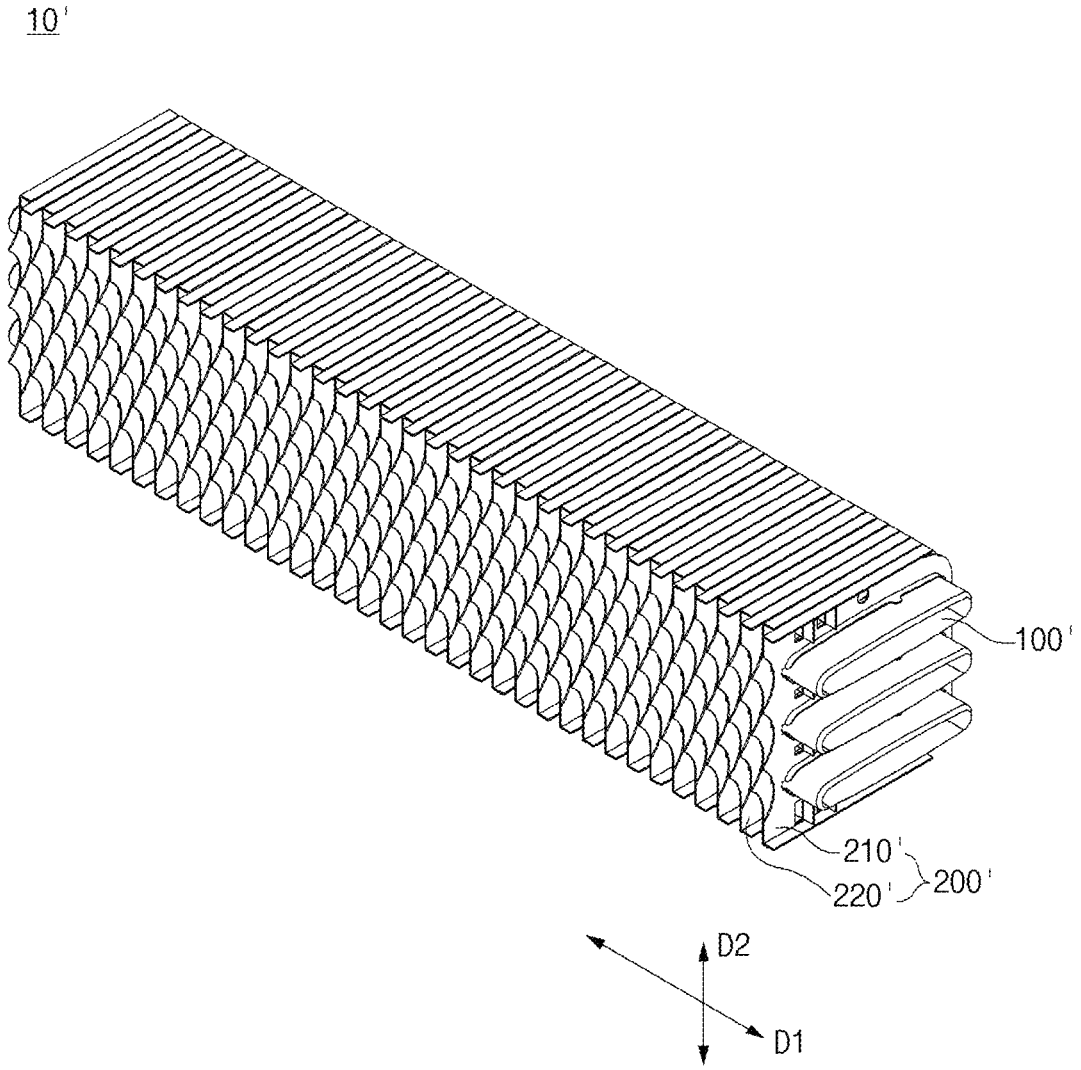
FIG. 7 is a perspective view illustrating a heat exchanger according to a second embodiment of the present disclosure.
Figure 8:
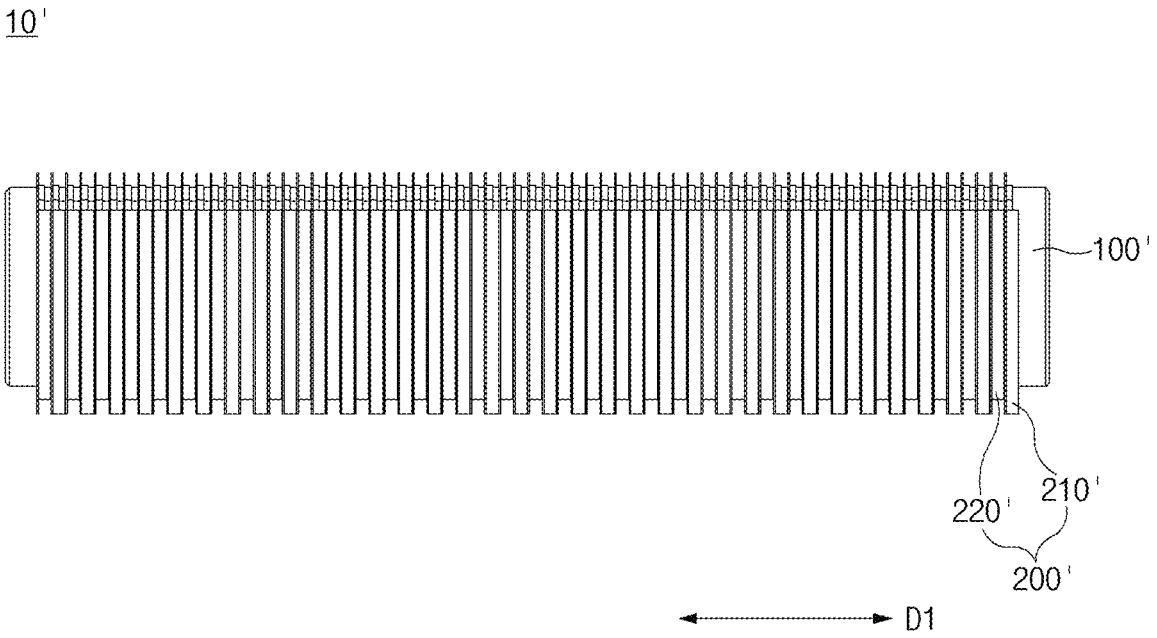
FIG. 8 is a front view of a heat exchanger according to a second embodiment of the present disclosure.
Figure 9:
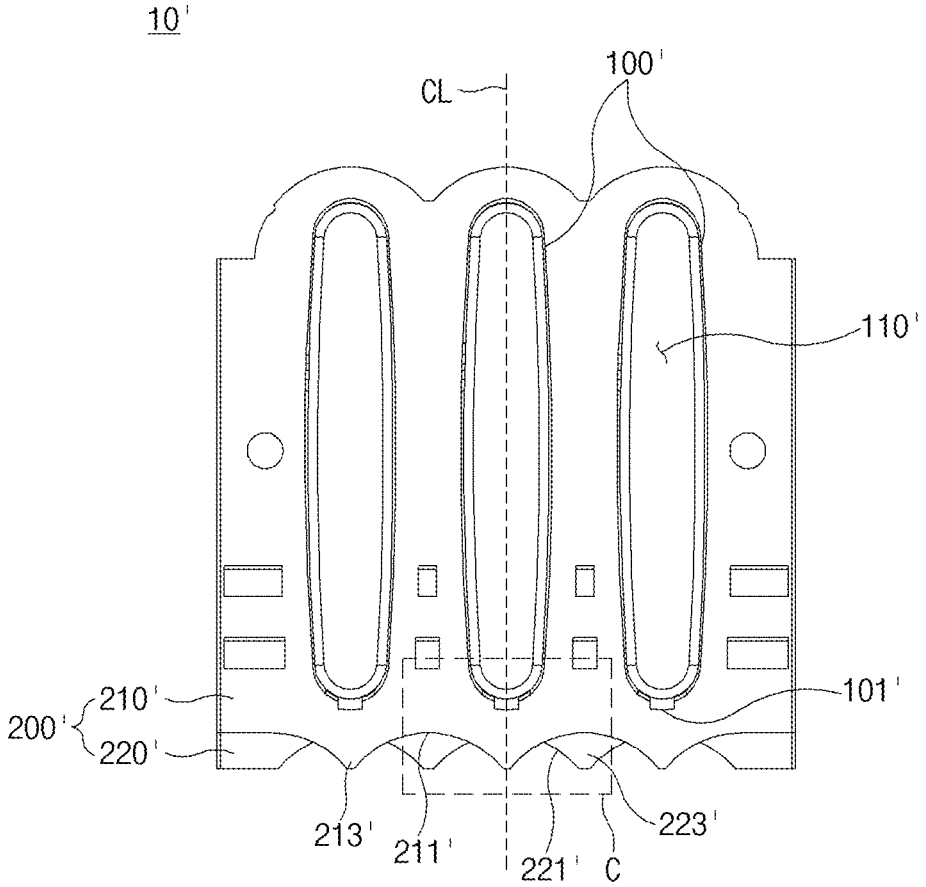
FIG. 9 is a view illustrating a heat exchanger according to a second embodiment of the present disclosure, and is a side view of FIG. 8, when viewed from a lateral side.
Figure 10:
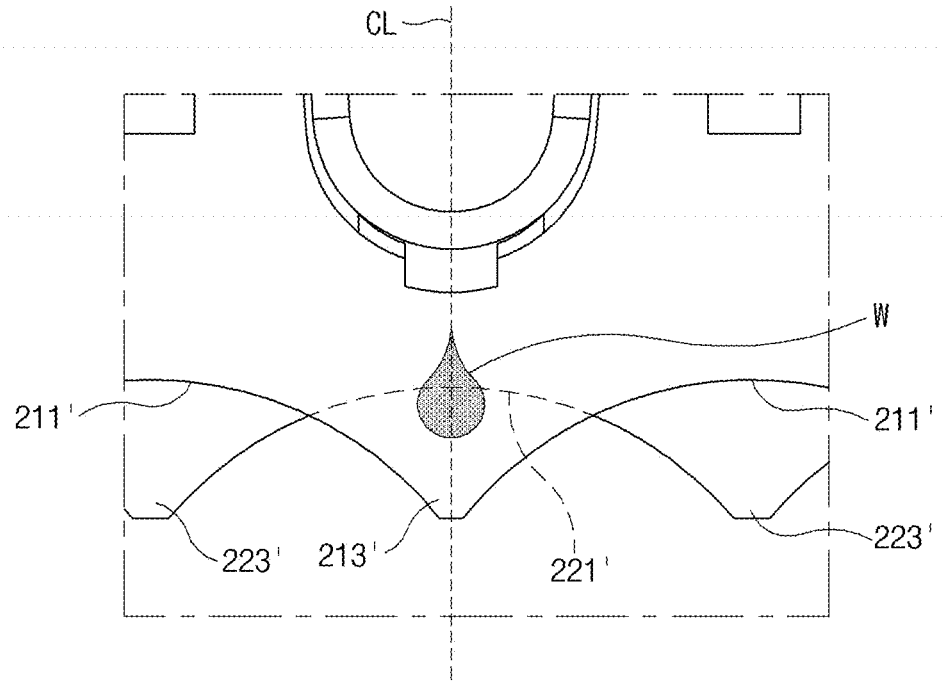
FIG. 10 is an enlarged view illustrating portion "C" of FIG. 9.
Figure 11:
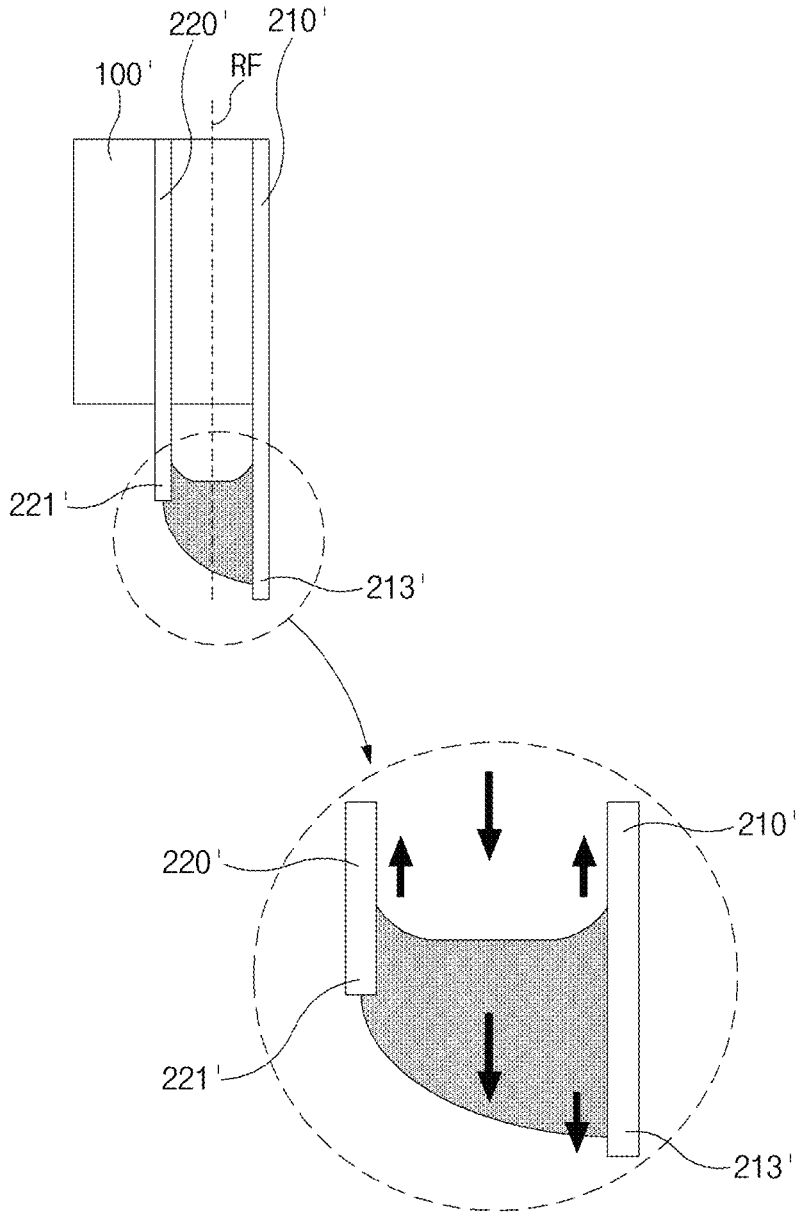
FIG. 11 is a view illustrating a heat exchanger according to a second embodiment of the present disclosure, and is a view illustrating a part of FIG. 8 and an enlarged view thereof.

FIGS. 7 to 11 illustrate a heat exchanger 10' according to a second embodiment of the present disclosure. FIG. 7 is a perspective view illustrating a heat exchanger according to a second embodiment of the present disclosure, FIG. 8 is a front view of the heat exchanger according to the second embodiment of the present disclosure, FIG. 9 is a view illustrating the heat exchanger according to the second embodiment of the present disclosure, and is a side view of FIG. 8, when viewed from a lateral side, FIG. 10 is an enlarged view illustrating portion "C" of FIG. 9, and FIG. 11 is a view illustrating the heat exchanger according to the second embodiment of the present disclosure, and is a view illustrating a part of FIG. 8 and an enlarged view thereof.

The heat exchanger 10' according to the second embodiment of the present disclosure is different in a shape of a heat exchange fin 200' compared to the first embodiment described above. Accordingly, the heat exchanger 10' according to the second embodiment of the present disclosure may include all of the components of the first embodiment described above, except for the differences described above. Hereinafter, a repeated description of the same components will be omitted.

Referring to FIGS. 7 to 11, when an extension direction of a tube 100' is defined as a first direction D1, and a direction that is perpendicular to the first direction D1 and parallel to a ground is defined as a second direction D2, a first heat exchange fin 210' may include a plurality of first recessed parts 211' that are formed to be concave in the upward direction and disposed along the second direction D2. Furthermore, the second heat exchange fin 220' may include a plurality of second recessed parts 221' that are formed to be concave in the upward direction and are disposed along the second direction D2.

Here, the plurality of first recessed parts 211' and the plurality of second recessed parts 221' may be alternately disposed when viewed in the first direction D1.

In detail, when the first heat exchange fin 210' and the second heat exchange fin 220' may have shapes, in which the first recessed parts 211' and the second recessed parts 221' cross each other when viewed toward the first direction D1. Accordingly, when the condensate "w" is formed, the surfaces of the first heat exchange fin 210' and the second heat exchange fin 220', which face each other with the condensate "w" being interposed therebetween, may be formed to be asymmetrical to each other.

In this case, as illustrated in FIGS. 10 and 11, areas that do not overlap each other when viewed from the first direction D1 exist. In the non-overlapping area, a force that acts on the condensate "w" in the direction of the gravity by a part of one of the lower end of the first heat exchange fin 210' and the lower end of the second heat exchange fin 220', which extends further toward a lower side, may be added. That is, a surface tension may be added between the part that extends further toward the lower side, and the condensate "w", and then, the added surface tension may become a force that acts on the condensate "w" in the direction of the gravity.

In this way, according to the present disclosure, a force that acts on the condensate "w" in the direction of the gravity (the downward direction) is added, and thus, as compared to the conventional technology, the condensate "w" that is formed between the first heat exchange fin 210 and the second heat exchange fin 220 falls to a lower side more easily. Accordingly, the condensate "w" may be discharged smoothly.

The first heat exchange fin 210' may further include first lower end parts 213' that are formed between the plurality of first recessed parts 211'. For example, when an imaginary center line that extends from a center of the tube 100' in the second direction D2 is defined as an imaginary center line CL when viewed in the first heat exchange fin 210' from the first direction D1, the first lower end parts 213' may be located on the imaginary center line CL.

Furthermore, the second heat exchange fin 220' may further include a plurality of second lower end parts 223' that are formed between the plurality of second recessed parts 221'. Furthermore, when an imaginary center line that extends from a center of the tube 100' in the second direction D2 is defined the imaginary center line CL when viewed in the second heat exchange fin 220' from the first direction D1, the plurality of second lower end parts 223' may be located on both sides of the imaginary center line CL in the second direction D2. That is, the second lower end parts 223' that are adjacent to each other may be formed to face each other with the imaginary center line CL being interposed therebetween.

In this way, the first lower end parts 213' of the first heat exchange fins 210' are disposed on the lower side of the tube 100', and the second lower end parts 223' of the second heat exchange fins 220' are disposed on both sides of the tube 100' in the second direction D2 whereby the first lower end parts 213' and the second lower end part 223' may be alternately disposed when the heat exchanger 10' is viewed in the first direction D1.

Due to this shape, when viewed from the first direction D1, areas that do not overlap each other exist in the first heat exchange fin 210' and the second heat exchange fin 220'. In the non-overlapping area, a force that acts on the condensate "w" in the direction of the gravity by a part of one of the lower end parts of the first heat exchange fins 210' and the lower end parts of the second heat exchange fin 220', which extends further toward a lower side, may be added.

According to the second embodiment of the present disclosure, the overall height of the lower ends of the first heat exchange fin 210' and the overall height of the lower ends of the second heat exchange fin 220' may be the same within an error range. As a result, according to the second embodiment of the present disclosure, the overall size of the product may not be increased.

However, the first heat exchange fin 210' and the second heat exchange fin 220' are not limited to the above description and the drawings, and may be modified into various shapes as long as a first recessed part 211' and a second recessed part 221' may be arranged alternately.

The components of the first embodiment and second embodiment of the present disclosure described above are not in conflict with each other. Therefore, other embodiments of the present disclosure may include both the above-described components of the first embodiment and the second embodiment. For example, in another embodiment of the present disclosure, a difference between the heights of the lower end of the tube 100 and the lower end of the first heat exchange fin 210 may be different from a difference between the heights of the lower end of the tube 100 and the lower end of the second heat exchange fin 220, and also the plurality of first recessed parts 211 and the plurality of second recessed parts 221 may be alternately disposed.

Figure 12:
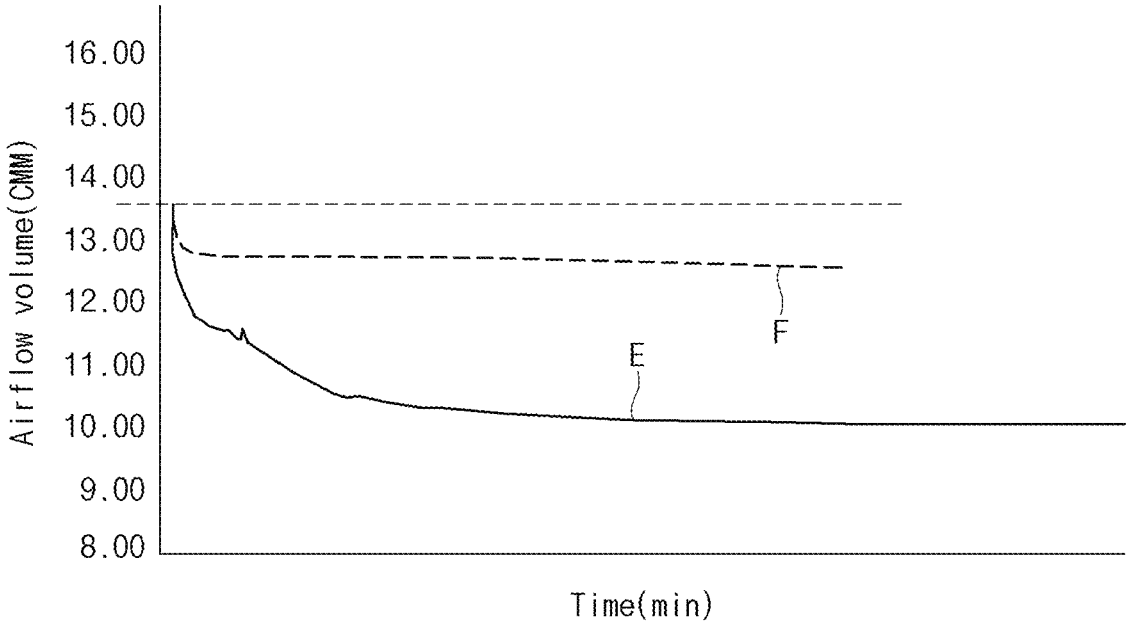
FIG. 12 illustrates an experimental example that is done by using a heat exchanger according to a first embodiment of the present disclosure.

Hereinafter, the effects of the present disclosure will be described with reference to FIG. 12. FIG. 12 illustrates an experiment of the effects of the present disclosure using the first embodiment and a comparative example of the present disclosure.

Figure 1:
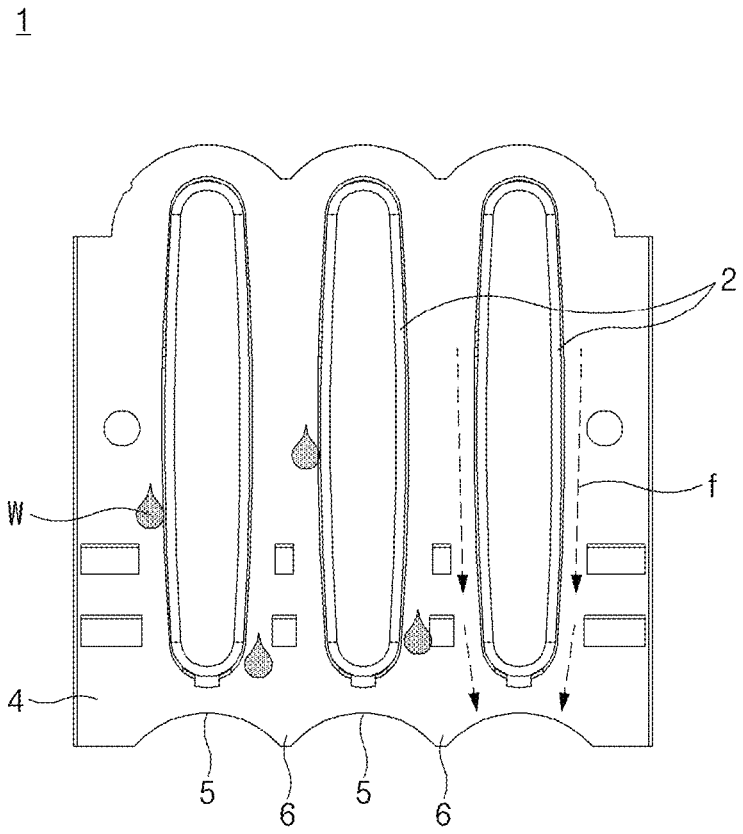
FIG.1 PRIOR ART
FIG. 1 is a side view of a conventional heat exchanger, when viewed from a lateral side.
Figure 2:
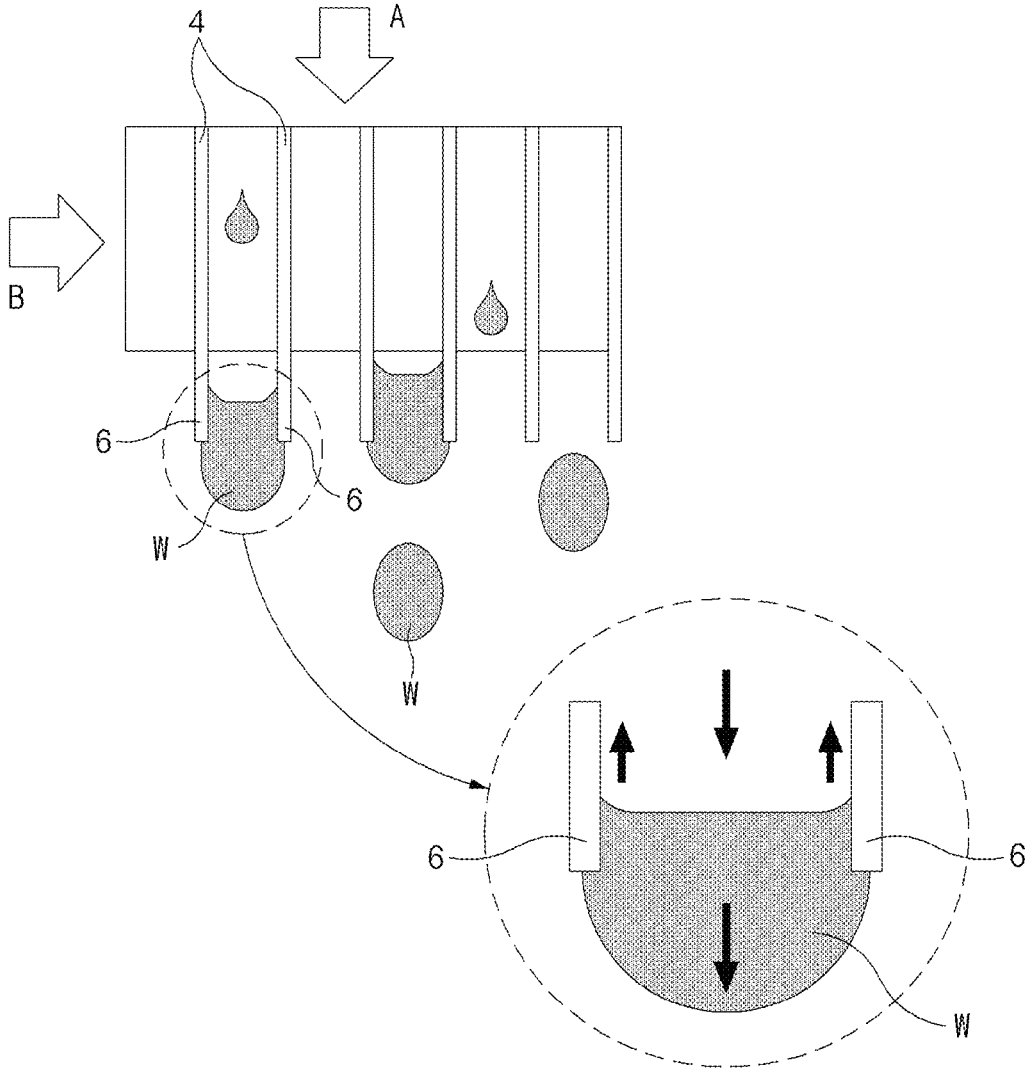
FIG.2 PRIOR ART
FIG. 2 is a front view of a conventional heat exchanger, when viewed from a front side, and an enlarged view thereof.

In the first embodiment of the present disclosure used in the experiment, a difference between the height between the lower end of the tube 100 and the lower end of the first heat exchange fin 210, and the height between the lower end of the tube 100 and the lower end of the second heat exchange fin 220 is 4 mm. In the heat exchanger 10 according to the comparative example in the present disclosure, the first exchange pin and the second exchange pin are formed to overlap each other (see FIGS. 1 and 2) when viewed in the first direction D1.

Furthermore, in the first embodiment and comparative example, an experiment for comparing an airflow volume when only air was injected into an outer space of the heat exchanger 10 and when air and water were injected together was conducted, and the experimental results were illustrated in a graph. Here, the airflow volume means an airflow volume that was measured on a lower side of the heat exchanger 10 after air, or air and water were injected from the upper side of the heat exchanger 10.

"E" in the graph illustrated in FIG. 12 represents the results of measuring the airflow volume over time while only air was injected and then water was injected together by using a comparative example. "F" in the graph illustrated in FIG. 12 is the result of measuring the airflow volume over time while only air is injected and then water was injected together by using the first embodiment of the present disclosure. In the graph, the X axis represents time (min), and the Y axis represents an airflow volume (CMM). As time passed, it was confirmed that the airflow volume gradually decreased due to the resistance of the condensate "w" formed between the adjacent heat exchange fins 200.

As the experimental result of the comparative example, it was identified that the airflow volume measured shortly before the water was injected was 13.5 CMM, and the airflow volume measured after the water was injected for about 8 hours was 10.06 CMM. That is, as the experimental results of the comparative example, it was identified that the airflow volume was approximately 2.9 CMM.

In the first embodiment of the present disclosure, it was identified that the airflow volume measured shortly before water was injected was 13.5 CMM, and the airflow volume measured after water was injected for about 5 hours was 12.6 CMM. That is, as the experimental results of the comparative example, it was identified that the airflow volume was approximately 2.9 CMM.

It may be identified through the experimental results in the first embodiment that the condensate "w" was discharged smoothly due to the improvement in the shape of the heat exchange fins 200, and an airflow volume similar to the airflow volume before water injection is measured compared to the comparative example. Accordingly, by using the present disclosure, the condensate "w" may be smoothly discharged between the heat exchange fins 200.

According to the present disclosure, because the shapes and sizes of the adjacent heat exchange fins are formed differently, a force in the direction of the gravity is added to the condensate formed between opposing surfaces whereby the condensate may be smoothly discharged.

Therefore, according to the present disclosure, the thermal efficiency of the heat exchanger may be increased by increasing a condensation and latent heat exchange performance.

Although the specific embodiments of the present disclosure have been described in detail, the idea and scope of the present disclosure are not limited to the specific embodiments, and the present disclosure may be corrected and modified in various ways by a person of an ordinary skill in the field, to which the present disclosure pertains, while not changing the gist of the present disclosure described in the claims.

The invention claimed is:

1. A heat exchanger comprising:

a tube including a flow space, in which a heating medium flows, in an interior thereof; and a plurality of heat exchange fins coupled to an outer surface of the tube, and disposed to be spaced apart from each other along an extension direction of the tube, wherein adjacent ones of the plurality of heat exchange fins have different shapes when viewed in the extension direction of the tube, wherein when any one of the adjacent heat exchange fins is defined as a first heat exchange fin, and the other is defined as a second heat exchange fin, wherein when the extension direction of the tube is defined as a first direction, and a direction being perpendicular to the first direction and parallel to a ground is defined as a second direction, the first heat exchange fin includes a plurality of first recessed parts formed to be recessed in an upward direction and disposed along the second direction, the second heat exchange fin includes a plurality of second recessed parts formed to be recessed in the upward direction and disposed along the second direction, and the plurality of first recessed parts and the plurality of second recessed parts are disposed alternately when viewed in the first direction.

2. The heat exchanger of claim 1, wherein the first heat exchange fin and the second heat exchange fin are repeatedly disposed along the extension direction of the tube, and shapes of parts thereof, which are located on a lower side of the tube, are formed to be different.

3. The heat exchanger of claim 2, wherein a difference between heights of a lower end of the tube and a lower end of the first heat exchange fin is formed to be different from a difference between heights of a lower end of the tube and a lower end of the second heat exchange fin.

4. The heat exchanger of claim 1, wherein when an imaginary center line extending from a center of the tube in the second direction is defined as the imaginary center line when the first heat exchange fin is viewed in the first direction, the first heat exchange fin includes first lower end parts formed between the plurality of first recessed parts, and the first lower end parts are located on the imaginary center line.

5. The heat exchanger of claim 1, wherein when an imaginary center line extending from a center of the tube in the second direction is defined as the imaginary center line when the second heat exchange fin is viewed in the first direction, the second heat exchange fin includes a plurality of second lower end parts formed between the plurality of second recessed parts, and the plurality of second lower end parts are disposed on both sides of the imaginary center line in the second direction.

6. A heat exchanger comprising:

a tube including a flow space, in which a heating medium flows, in an interior thereof; and a plurality of heat exchange fins coupled to an outer surface of the tube, and disposed to be spaced apart from each other along an extension direction of the tube, wherein adjacent ones of the plurality of heat exchange fins are formed such that at least partial areas thereof, which are located on a lower side of the tube, do not overlap each other when viewed in the extension direction of the tube, wherein when any one of the adjacent heat exchange fins is defined as a first heat exchange fin, and the other is defined as a second heat exchange fin, wherein when the extension direction of the tube is defined as a first direction, and a direction being perpendicular to the first direction and parallel to a ground is defined as a second direction, the first heat exchange fin includes a plurality of first recessed parts formed to be recessed in an upward direction and disposed along the second direction, the second heat exchange fin includes a plurality of second recessed parts formed to be recessed in the upward direction and disposed along the second direction, and the plurality of first recessed parts and the plurality of second recessed parts are disposed alternately when viewed in the first direction.

* * * * *